US009530315B2

(12) United States Patent
Baese et al.

(10) Patent No.: US 9,530,315 B2
(45) Date of Patent: Dec. 27, 2016

(54) METHOD AND DEVICE FOR ESTABLISHING AN ALTERNATE ROUTE IN THE EVENT OF A BLOCKED ROADWAY IN A MONITORED REGION

(71) Applicant: SIEMENS AKTIENGESELLSCHAFT, Munich (DE)

(72) Inventors: Gero Baese, Munich (DE); Stephan Ehling, Haag (DE); Ralf Mahnkopf, Wasserburg (DE)

(73) Assignee: Siemens Schweiz AG, Zurich (CH)

( * ) Notice: Subject to any disclaimer, the term of this patent is extended or adjusted under 35 U.S.C. 154(b) by 124 days.

(21) Appl. No.: 14/351,619

(22) PCT Filed: Oct. 9, 2012

(86) PCT No.: PCT/EP2012/069914

§ 371 (c)(1),
(2) Date: Apr. 14, 2014

(87) PCT Pub. No.: WO2013/053677

PCT Pub. Date: Apr. 18, 2013

(65) Prior Publication Data

US 2014/0249746 A1 Sep. 4, 2014

(30) Foreign Application Priority Data

Oct. 14, 2011 (DE) ..... 10 2011 084 560

(51) Int. Cl.

| | |
|---|---|
| ***G08G 1/123*** | (2006.01) |
| *G08G 1/0967* | (2006.01) |
| *G08G 1/00* | (2006.01) |

(52) U.S. Cl.

CPC ..... *G08G 1/123* (2013.01); *G08G 1/207* (2013.01); *G08G 1/096741* (2013.01); *G08G 1/096775* (2013.01); *G08G 1/202* (2013.01)

(58) Field of Classification Search

None

See application file for complete search history.

(56) References Cited

U.S. PATENT DOCUMENTS

| | | | |
|---|---|---|---|
| 6,718,235 | B1 | 4/2004 | Borugian |
| 6,799,100 | B2 | 9/2004 | Burns et al. |

(Continued)

FOREIGN PATENT DOCUMENTS

| | | | |
|---|---|---|---|
| DE | 10348635 | A1 | 5/2005 |
| DE | 102007029131 | A1 | 1/2009 |

(Continued)

*Primary Examiner* — Mussa A Shaawat
*Assistant Examiner* — Kyung Kim
(74) *Attorney, Agent, or Firm* — Laurence Greenberg; Werner Stemer; Ralph Locher

(57) ABSTRACT

A method and a device for establishing an alternate route in the event of a blocked roadway in a monitored region, in particular in an airport ramp. A vehicle is authorized to bypass the blocked roadway by a control center. Position data are repeatedly ascertained with respect to the vehicle by way of a position determining device. The data of the bypass route are ascertained from the position data by way of a computing device. The bypass route data are stored in a memory associated with the control center. Furthermore, authorization data which apply to the blocked roadway and which are stored in the memory are transmitted to the bypass route.

8 Claims, 2 Drawing Sheets

(56) References Cited

U.S. PATENT DOCUMENTS

| | | | | |
|---|---|---|---|---|
| 6,975,923 | B2 | 12/2005 | Spriggs | |
| 7,975,959 | B2 | 7/2011 | Perry et al. | |
| 8,660,794 | B2 | 2/2014 | Currie et al. | |
| 2004/0133341 | A1* | 7/2004 | Spriggs | G08G 5/0013 701/435 |
| 2007/0198168 | A1 | 8/2007 | Nathan et al. | |
| 2011/0125401 | A1 | 5/2011 | Staehlin | |

FOREIGN PATENT DOCUMENTS

| | | | |
|---|---|---|---|
| DE | 102008042999 | A1 | 4/2010 |
| EP | 2272759 | A1 | 1/2011 |
| EP | 2306431 | A2 | 4/2011 |
| GB | 2393836 | A | 4/2004 |
| WO | 03044632 | A2 | 5/2003 |

* cited by examiner

METHOD AND DEVICE FOR ESTABLISHING AN ALTERNATE ROUTE IN THE EVENT OF A BLOCKED ROADWAY IN A MONITORED REGION

BACKGROUND OF THE INVENTION

Field of the Invention

The invention relates to a method and a device for establishing an alternate route in the event of a blocked roadway in a monitored region, in particular on an airport ramp. Automatically guided vehicles, in particular road vehicles, are diverted on a road surface.

A method and a system for improving accuracy when determining the position of a moving object to be localized on an airport ramp is disclosed in DE 10 2007 029 131 A1. The object to be localized which, for example, is a bus, a tanker or a catering vehicle, has a GPS receiver, a computing device and a device for wireless communication. Determining the position of the object to be localized takes place within the object to be localized by using the GPS receiver which is present therein and the computing device which is present therein, wherein additional information is used for increasing the accuracy when determining the position, said information being transmitted to the object to be localized from a server of the airport control center. This additional information includes EGNOS signals, DGPS correction data and/or A-GPS data. The corrected position data ascertained in this manner is transmitted to the airport server associated with the control center.

Movements of vehicles on the airport ramp may be tracked by means of the known method described above, based on the GPS position determination which has been carried out. These vehicle movements take place within authorized regions. The adherence to these regions is monitored by the control center. If the respective vehicle leaves the authorized regions, then a suitable countermeasure is taken, for example an alarm is triggered.

If an authorized roadway is blocked, for example by an accident or a broken-down vehicle, then other vehicles wishing to use this roadway have to be able to bypass the blocked point of the roadway temporarily, without an alarm being triggered. To this end, the aforementioned blocked roadway has to be communicated to the control center. If this has occurred, then changes are manually made by an authorized person in the control center. This consists in incorporating a bypass for the blocked point of the roadway in the maps of a monitoring system which is present in the control center and adapting the authorizations for this region. Alternatively, potential bypasses may be defined in advance for each section of the roadways on the airport ramp and incorporated into the maps of the monitoring system.

If the aforementioned blocked roadway has been cleared, this in turn has to be communicated to the control center so that in the control center all of the changes which have been made are able to be canceled again.

BRIEF SUMMARY OF THE INVENTION

The object of the invention is to simplify the establishing of bypasses of a blocked roadway.

This object is achieved by a method as claimed and by a device as claimed. Advantageous embodiments and developments of the invention are set forth in the dependent claims.

One advantage of the invention is that the bypass of the blocked roadway is automatically established as soon as the control center is made aware of the existence of the blocked roadway. It is not necessary for an authorized person to incorporate a bypass for the blocked point into a map which is present in the control center. It is similarly not necessary to predefine potential bypasses for each section of the roadways, for example of an airport ramp.

A further advantage of the invention is that, when establishing the bypass of the section of the blocked roadway, circumstances unknown to the control center may also be taken into account, for example objects deposited on or adjacent to the roadway.

Further advantageous features of the invention are revealed from the following exemplary description thereof, with reference to the figures, in which:

DESCRIPTION OF THE INVENTION

Figure 1:
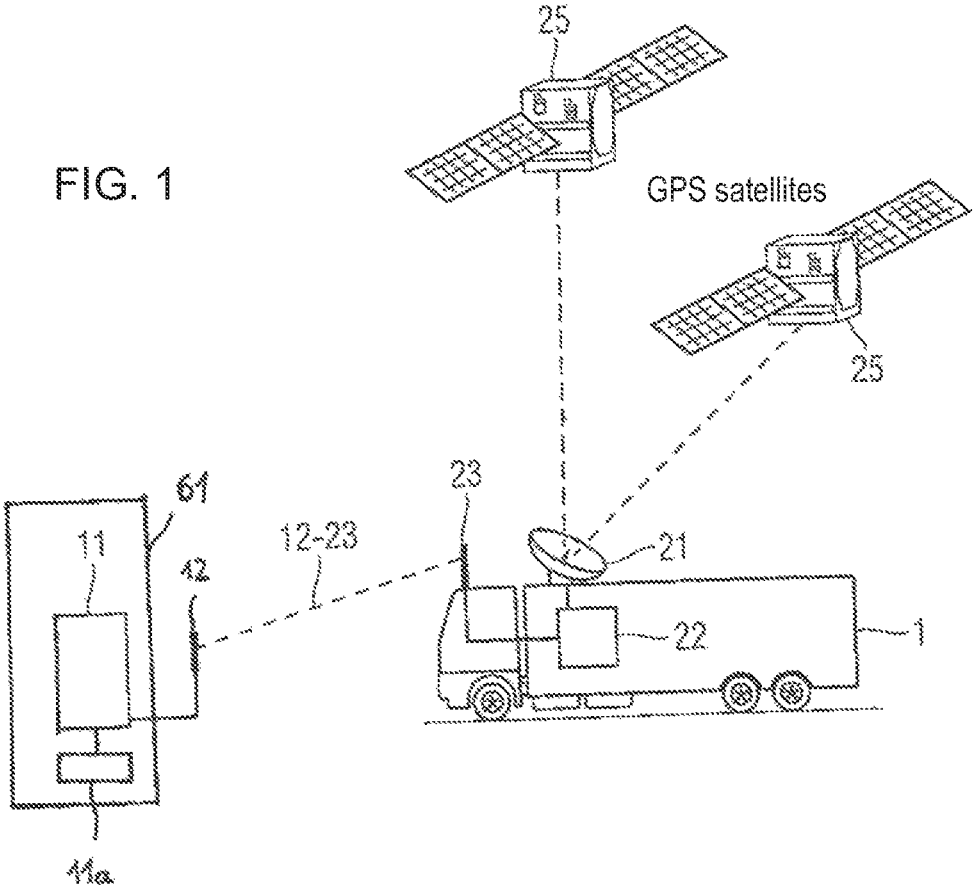
FIG. 1 shows a sketch which, for understanding the invention, contains the components of a device required for establishing an alternate route in the event of a blocked roadway on an airport ramp.

The device shown in FIG. 1 has a control center 61, a computing device 11 associated with the control center and a communication device 12 associated with the control center. Moreover, the device shown contains a vehicle 1 which is provided with a position determining device. In the exemplary embodiment shown, a GPS receiver 21 and a computing device 22 form part of said position determining device. The computing device 22 is connected to a communication device 23. The communication devices 12 and 23 are preferably radio transmission devices which are configured for the bidirectional transmission of radio signals between the control center and the vehicle via the transmission path 12-23. The GPS receiver 21 is provided for receiving signals which are emitted by GPS satellites 25. The computing device 22 determines position data which describes the current position of the vehicle 1 from the received signals emitted by the GPS satellites. For increasing the accuracy of this position data, the computing device 22 is able to use correction data as disclosed in DE 10 2007 029 131 A1.

A plurality of roadways on which authorized vehicles move are located on the airport ramp. Each of said vehicles is registered by the control center 61 in the sense that data is stored in the computing device 11 of the control center and/or a memory provided therein, said data corresponding to identifiers of the individual vehicles, wherein data is stored for each identifier, said data corresponding to the current position of the respective vehicle, as well as further data which characterizes the current use of the vehicle. Thus further data is stored, for example relative to the vehicle shown in FIG. 1, which authorizes the vehicle 1 to use a specific roadway on the airport ramp in a specific time period.

When the vehicle 1 travels on this roadway, position data of the vehicle moving on the roadway is transmitted during predetermined time periods from the vehicle to the control center via the radio transmission path 12-23 by the position determining device 21, 22 of the vehicle 1. In the control center, the computing device provided therein continuously monitors whether the vehicle 1 is actually moving on the roadway cleared for the vehicle 1. If the vehicle 1 leaves said roadway, this is identified by the computing device 11 of the control center and an alarm is triggered. If the roadway on which the vehicle 1 is currently moving is blocked, for example due to a breakdown of a vehicle traveling ahead, then the driver of the vehicle 1 informs the control center, for example by means of a radio telephone, that the roadway is blocked and at which point the roadway is blocked.

The control center 11 then authorizes the vehicle 1 to take a bypass from the blocked roadway. As a result of this authorization, the driver of the vehicle 1 is able to take a bypass from the blocked roadway by taking into account the local environment around the blocked roadway. In this case, the driver is also able to leave the blocked roadway without the control center initiating the triggering of an alarm. During this bypass from the blocked roadway, position data of the vehicle 1 bypassing the blocked roadway is repeatedly ascertained by the position determining device 21, 22 of the vehicle 1 and transmitted to the control center 21 and/or the computing device 11 thereof via the radio transmission path 12-23.

The computing device 11 of the control center 61 ascertains from this position data the data describing the bypass route and stores said data in a memory associated with the control center.

Subsequently, using further data which has already been stored, said data being authorization data applicable to the blocked roadway, the computing device 11 of the control center 61 monitors which other vehicles have been given authorization to use the roadway which is now blocked and transfers said authorization data to the bypass route.

When this has occurred, the control center then informs all relevant vehicles about the existence of the blocked roadway and about the new authorization of the respective vehicle to be allowed to use the bypass route.

Due to this transmission transfer of the authorization data to the bypass route, all vehicles to which this authorization has been given may use the bypass route without an alarm being triggered by the control center.

When the aforementioned blocked roadway has been cleared, the control center 11 is informed about the clearing of the blockage. As a result, the control center cancels the above-described transfer of authorization data to the bypass route again so that the status before the occurrence of the blockage is re-established.

As has been described above, within the subject matter of the present invention, the establishing of an alternate route and the canceling of said alternate route take place automatically when the information about the presence of a blocked roadway and/or the information about the clearing of the blocked roadway is received by the control center. The alternate route is established by using position data which is made available when the roadway is bypassed, by a vehicle authorized by the control center to bypass the blocked roadway.

When bypassing the blocked roadway, the driver of the vehicle bypassing the blocked roadway is advantageously able to take into account local conditions which are not known to the control center, for example objects deposited adjacent to the roadway.

Figure 2:
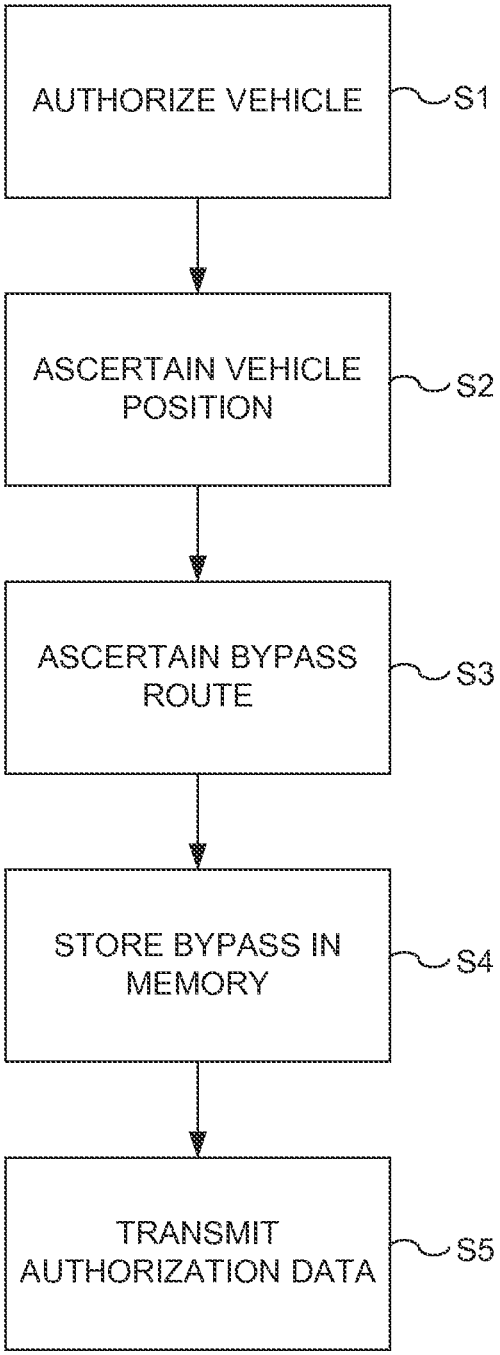
FIG. 2 shows a flow diagram for explaining a method for establishing an alternate route in the event of a blocked roadway on an airport ramp.

FIG. 2 shows a flow diagram for explaining a method for establishing an alternate route in the event of a blocked vehicle on an airport ramp.

This method assumes that it is already known to the control center 61 which roadway of the airport ramp is blocked and at which point of the roadway this blockage occurs.

As soon as the control center has obtained information about the aforementioned blockage, in a step S1 it authorizes a subsequent vehicle to bypass the blocked roadway. The driver of the vehicle is informed about this authorization. The driver then has the option of leaving the blocked roadway, in order to bypass the blocked point of the roadway, without an alarm being triggered in the control center.

Whilst the vehicle bypasses the blocked point, in a step S2 position data of the authorized vehicle bypassing the blocked roadway is repeatedly ascertained by means of the position determining device 21, 22 of the vehicle.

Subsequently in a step S3, the data of the bypass route is ascertained from the position data ascertained by means of the computing device 22 of the position determining device or by means of the computing device 11 of the control center. If said data of the bypass route is ascertained, then in a step S4 said data is stored in a memory 11*a* associated with the control center 61.

In a step S5, authorization data which applies to the blocked roadway, which is stored in the memory 11*a* and which is associated with further vehicles, is then transferred by the control center 61 to the bypass route. Due to the transfer of this authorization data, the aforementioned further vehicles may also use the predetermined bypass route without an alarm being triggered in the control center and/or without other countermeasures being taken by the control center.

When the blocked roadway is cleared, the aforementioned transfer of authorization data to the bypass route is cancelled by the control center.

A method and a device for establishing an alternate route in the event of a blocked roadway on an airport ramp has been described above. Alternatively, the described method and the described device may also be used for establishing an alternate route in the event of a blocked roadway in a different monitored region, for example in a port or a chemical plant.

The invention claimed is:

1. A method of establishing an alternate route on occasion of a blocked roadway within a monitored region, the method comprising the following steps:

authorizing a vehicle to bypass the blocked roadway by a control center, the vehicle thus being an authorized vehicle;

repeatedly ascertaining position data of the authorized vehicle bypassing the blocked roadway by a position determining device;

ascertaining data of a bypass route from the ascertained position data by a computing device of the position determining device or by a computing device of the control center;

storing the data of the bypass route in a memory associated with the control center;

transferring authorization data that are stored in a memory and that apply to the blocked roadway to the bypass route to render the bypass route an authorized roadway;

transmitting information about the bypass route from the control center to those vehicles to which authorization had been given to use the blocked roadway to now use the bypass route.

2. The method according to claim 1, wherein the control center is informed about the blocked roadway by way of a radio telephone.

3. The method according to claim 1, which comprises identifying the blocked roadway by the control center using successive transmissions of unaltered position data of a vehicle causing the blocked roadway.

4. The method according to claim 1, which comprises preventing an alarm to be triggered by the control center when authorized vehicles drive along the bypass route while the roadway is blocked.

5. A system for establishing an alternate route in the event of a blocked roadway in a monitored region, the device comprising:

a control center, a computing device associated with said control center, and a communication device associated with said control center;

said control center being configured, upon receiving information about the blocked roadway, to authorize a vehicle to bypass the blocked roadway, to store data of an ascertained bypass route in a memory, and to transfer authorization data which applies to the blocked roadway and which is stored in memory to the bypass route;

said control center being further configured to cause said communication device to transmit to other vehicles, which were authorized to use the blocked roadway, information regarding the bypass route and to inform the other vehicles that they now have authorization to use the bypass route.

6. The system according to claim 5, wherein the vehicle authorized by said control center to bypass the blocked roadway has a position determining device for repeatedly ascertaining position data of the vehicle and a communication device disposed on or in the vehicle, said position determining device is configured to repeatedly ascertain position data of the vehicle when the blocked roadway is being bypassed, after the vehicle has been authorized to bypass the blocked roadway.

7. The system according to claim 6, wherein said position determining device comprises a computing device configured to ascertain the data of the bypass route from the repeatedly ascertained position data and to transmit the data of the bypass route via said communication device of the vehicle to said communication device of said control center.

8. The system according to claim 5, wherein said computing device associated with said control center is configured to ascertain the data of the bypass route from position data received via said communication device.

* * * * *